United States Patent [19]

Feldmann et al.

[11] 4,440,012

[45] Apr. 3, 1984

[54] ROLLING STAND WITH NONCYLINDRICAL ROLLS

[75] Inventors: Hugo Feldmann, Alsdorf; Friedrich Hollmann, Grevenbroich; Gerd Beisemann, Düsseldorf; Horst Gärtner, Neuss, all of Fed. Rep. of Germany

[73] Assignee: SMS Schloemann-Siemag AG, Düsseldorf, Fed. Rep. of Germany

[21] Appl. No.: 311,449

[22] Filed: Oct. 14, 1981

[30] Foreign Application Priority Data

Oct. 15, 1980 [DE] Fed. Rep. of Germany ..... 3038865

[51] Int. Cl.[3] ..... B21B 27/02; B21B 31/18

[52] U.S. Cl. ..... 72/201; 72/247; 72/366

[58] Field of Search ..... 72/177, 179, 240, 243, 72/247

[56] References Cited

U.S. PATENT DOCUMENTS 2,442,943 6/1948 Wayne ..... 72/234

3,857,268 12/1974 Kajiwaka ..... 72/247

FOREIGN PATENT DOCUMENTS 53-2372 1/1978 Japan ..... 72/247

*Primary Examiner*—Lowell A. Larson

*Assistant Examiner*—Jorji M. Griffin

*Attorney, Agent, or Firm*—Karl F. Ross; Herbert Dubno

[57] ABSTRACT

A rolling stand has a conventional housing defining a pair of parallel and spaced axes defining a plane. Respective rolls have roll ends journaled in the housing at the axes and roll bodies axially symmetrical about the respective axes and having centered on the respective axes complementary roll-body surfaces of noncylindrical shape and each formed by rotation of a continuously curved generatrix about the respective axis. One of these contoured rolls is displaceable axially relative to the other roll from an end position to another position, and the roll-body surfaces form at the plane in the other position a uniform nip and in the end position a nonuniform nip. This system is set up to be able to displace one of the rolls axially relative to the other of the rolls between the end position and the other position. These contoured rolls may themselves define the nip, or may engage and deform other rolls that define it.

10 Claims, 7 Drawing Figures

ROLLING STAND WITH NONCYLINDRICAL ROLLS

FIELD OF THE INVENTION

The present invention relates to a rolling stand. More particularly this invention concerns a rolling stand whose rolls have bodies of noncylindrical shape.

BACKGROUND OF THE INVENTION

It is known, as for example from German patent document No. 2,919,105 filed by R. Verbickas et al with a claim to the priority of U.S. application Ser. No. 907,502 filed May 19, 1978, now abandoned, and from U.S. Pat. Nos. 2,776,586 and 3,857,268, to use working rolls of noncylindrical shape in a roll stand, and to provide means for displacing at least one of these rolls axially relative to the other and for bending at least one of these rolls. In this manner it is possible to change the dimension of the gap or so-called nip formed between the two rolls.

The disadvantage of such a system is that the provision of the bending equipment for the roll adds considerably to the cost of the rolling stand. On the one hand it is necessary to provide roll-bending devices that bend the ends of the roll away from the nip, so-called positive bending, and separate equipment for bending of the ends of the roll toward the nip, so-called negative bending. Positive bending increases the pressure at the longitudinal edges of a workpiece being rolled and negative bending decreases this pressure, for corresponding decreases and increases in workpiece thickness at these edges.

It is possible to achieve only minimal variations in nip dimensions without this bending equipment. That is, without using the bending equipment it is impossible to achieve anything other than slight variations in a workpiece with longitudinal edges thicker than its middle.

Not only is this type of arrangement quite expensive, but accurately establishing the proper amount of bend in conjuction with the right axial position of the working roll is very difficult, requiring expert setup personnel and frequent monitoring during operation to verify that the system remains properly set up. What is more, when positive bending is employed it is necessary to exert enormous forces against the working-roll ends, so that the roll-stand housing must be overdimensioned considerably.

OBJECTS OF THE INVENTION

It is therefore an object of the present invention to provide an improved roll stand.

Another object is the provision of such a roll stand which overcomes the above-given disadvantages.

A further object is to provide such an arrangement wherein the nip dimension can be adjusted virtually solely by axial displacement of one of the contoured rolls.

SUMMARY OF THE INVENTION

These objects are attained according to the instant invention in a rolling stand having a conventional housing defining a pair of parallel and spaced axes defining a plane. Respective rolls have roll ends journaled in the housing at the axes and roll bodies axially symmetrical about the respective axes and having centered on the respective axes complementary roll-body surfaces of noncylindrical shape and each formed by rotation of a continuously curved generatrix about the respective axis. One of these contoured rolls is displaceable axially relative to the other roll from an end position to another position, and the roll-body surfaces form at the plane only in the other position a uniform nip and in the end position a nonuniform nip. Finally the system has means for displacing one of the rolls axially relative to the other of the rolls between the end position and the other position. These contoured rolls may themselves define the nip, or may engage and deform other rolls that define it.

With this arrangement therefore the shape of the roll-body surfaces—wholly contoured with no cylindrical portions—allows the nip to be adjusted solely by axial displacement of one of the rolls relative to the other. In addition the shape of the nip and the corresponding cross section of the workpiece is varied by relatively minor shifting of the contoured roll, with no effect on the overall nip width. Thus the workpiece cross section can be changed without having to readjust for a different workpiece width.

According to a feature of the invention the roll bodies are of identical shape but the one roll is reversed 180° relative to the other roll. This is achieved most advantageously when the surfaces each have one half of outwardly convex shape and another half of outwardly concave shape. In such an arrangement it is possible for the nip to be set to impart to the workpiece a cross section of uniform thickness, of greater thickness at the outer longitudinal edges, or of greater thickness at the center. Regular and stepless variation from the one shape to the other can be easily achieved and will surely remain set in the apparatus. Even a relatively unskilled person can set up the rolling stand according to this invention to achieve the exact shape desired.

It is also possible according to another feature of the instant invention for the roll surfaces to be of different shape. One of the roll surfaces can be mostly outwardly convex and the other of the roll surfaces mostly outwardly concave, or the roll surfaces can each have a plurality of outwardly convex and a plurality of outwardly concave regions alternating axially. In these arrangements it is possible to achieve great variation in nip shape for all types of custom work, especially combined with feed devices that allow the workpiece to be fed into the nip at different axially offset locations.

The shape of the rolls can be milled right into the rolls, so that the roll surfaces are of the defined shapes at ambient temperature. Thus the desired shaped is simply machined into the contoured roll. It is also possible to use a roll that has at ambient temperature a roll body of cylindrical surface, and to provide means for differentially thermally influencing axially offset regions of the roll bodies for imparting the respective shapes thereto. Such means, as described in German patent document No. 2,908,641 based on a Dutch application filed March 6, 1978 by H. K. Quere and A. J. Tychon, normally includes a plurality of axially offset nozzles individually controllable for directing cold-liquid sprays at the respective regions of the roll. Those regions that are most heavily chilled will be of smaller diameter and, therefore, outwardly concave, and those which are allowed to run hot, as the rolls normally do, will be of greater diameter. The cold liquid is normally an oil/water/detergent emulsion used for flood lubrication of the rolls, and normally has a temperature of 20° C.–50° C.

According to another feature of this invention the roll stand has means for swinging one of the roll bodies into a position with its axis nonparallel to the axis of the other of the roll bodies but still in the plane of the axes of the housing. The gap dimension can similarly be varied by use of means for displacing one of the roll bodies into a position with its axis inclined to the plane of the axes of the housing.

It is also within the scope of this invention to use working rolls with cylindrical roll bodies, and backup rolls of the above-described contoured shapes. Thus the desired shape will be imparted by deformation to the working rolls.

The shape of the contoured roll is, of course, determined by the particular requirements of the mill. The axial shifting can be applied to only one of the rolls, with the other roll fixed, or both rolls can be axially oppositely shifted for maximum variation. The system according to this invention can be combined with virtually any standard rolling arrangement, such as systems for controlling strip thickness, systems for tipping one of the rolls, thermal-treatment arrangements, bend-straighteners, and the like. It is even possible to combine the inventive system with a roll-bending arrangement, such as in the prior-art devices, to even more widely expand the versatility of the inventive system.

DESCRIPTION OF THE DRAWING

The above and other features and advantages will become more readily apparent from the following, reference being made to the accompanying drawing in which.

SPECIFIC DESCRIPTION

Figure 1:
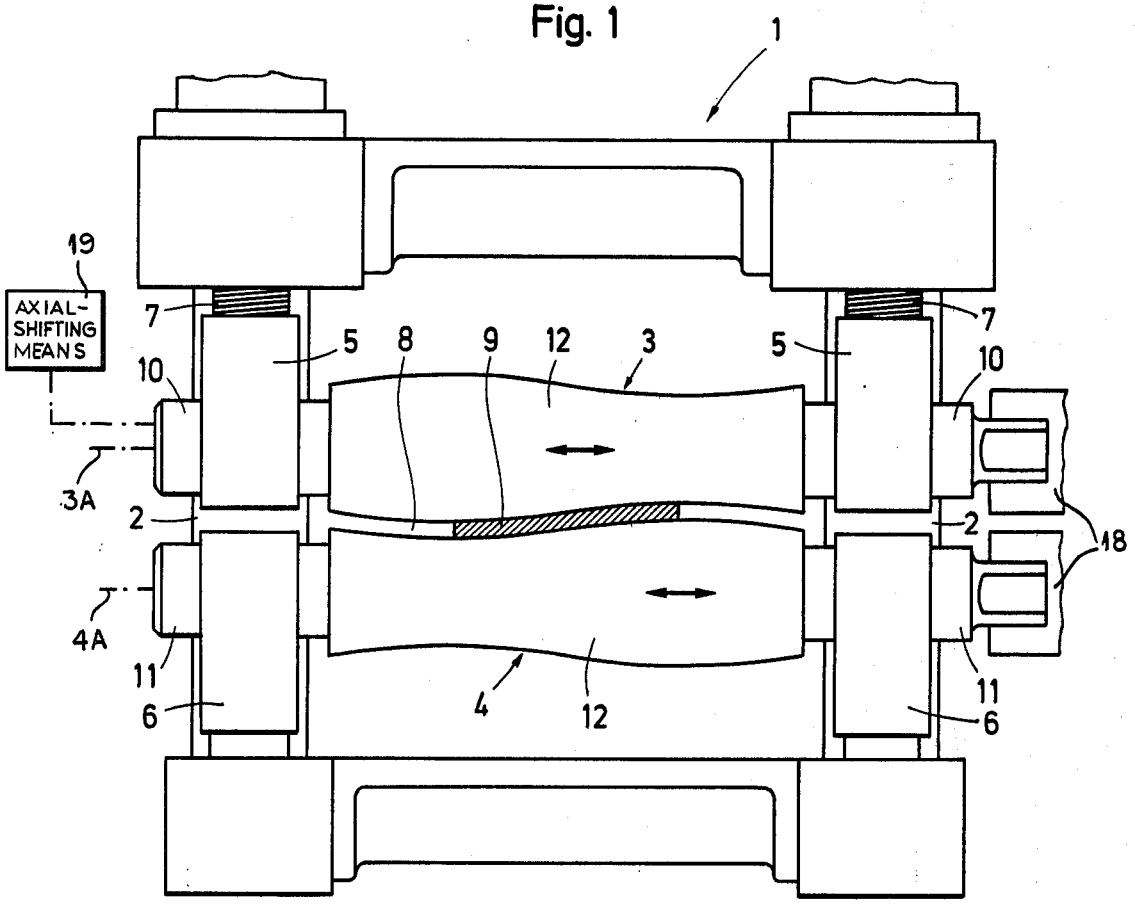
FIG. 1 is an end view of a two-high roll stand according to this invention.

As seen in FIGS. 1 and 4–6 a two-high roll stand 1 has a housing 2 carrying two contoured working rolls 3 and 4 respectively having ends 10 and 11 journaled in bearing blocks 5 and 6 of the housing 1. The rolls 3 and 4 are centered on respective axes 3A and 4A and define a nip 8 for a workpiece 9, here a steel strip. The blocks 5 can be moved vertically relative to the blocks 6 by standard adjustment screws 7 and axially by means indicated schematically at 19 and more specifically described in the above-cited patent documents. Means and blocks identical to the means 19 and blocks 5 may similarly be provided for the lower roll 4.

The rolls 3 and 4 have identical but oppositely oriented bottle-shaped bodies 12, each formed by rotation of a wholly curved generatrix about the respective axis 3A or 4A. The bodies 12 therefore each have an outwardly convex half and an outwardly concave half, each of an axial length equal to 2z (see FIG. 4). Appropriate drive means 18 are attached to the ends 10 and 11 to rotate the rolls 3 and 4 oppositely about the respective axes 3A and 4A.

Figure 4:
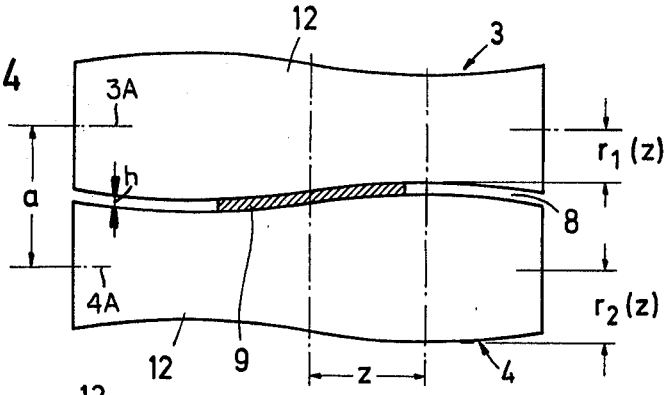
FIGS. 4, 5, and 6 are small-scale end views showing operation of the system of FIG. 1.

As shown in FIG. 4 if the two rolls 3 and 4 are aligned with their complementary roll-body surfaces directly opposite each other and their axes 3A and 4A parallel and at a spacing a, the workpiece 9 will be rolled to uniform thickness, albeit of slight S-shape. The nip 8 is of uniform height h so that:

$$h(z)=a-r_1(z)-r_2(z)$$

with $r_1$ and $r_2$ taken at the same axial location.

Figure 5:
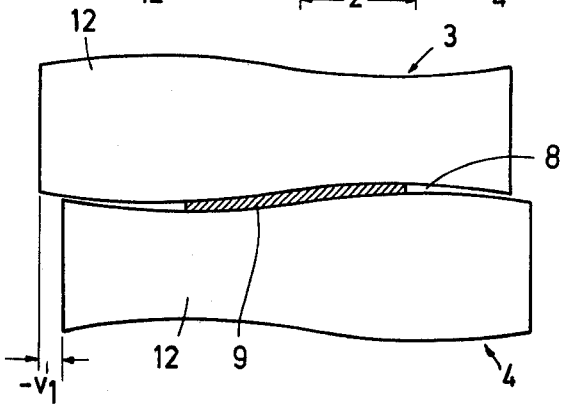
Figure 6:
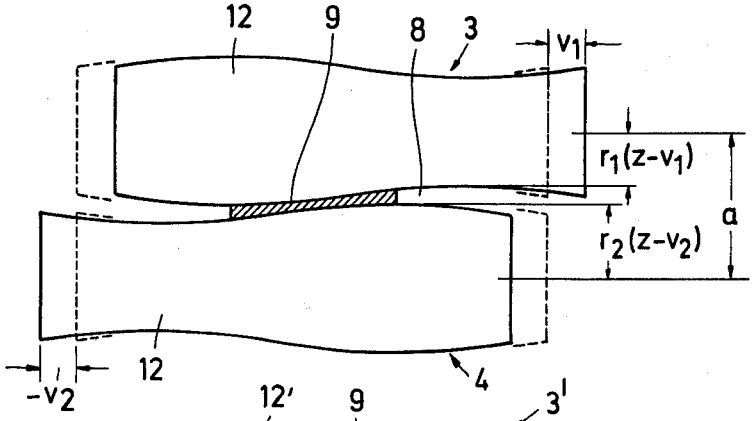

If one of the rolls 3 or 4 is shifted axially as shown in FIGS. 5 or 6 through a distance $v_1$ or $v_2$ the height of the nip 8 at any location can be determined by the formula:

$$h(z, v_1, v_2)=a-r_1(z-v_1)-r_2(z-v_2).$$

In FIG. 5 the workpiece 9 is rolled to a cross section with a relatively thick middle and relatively thin longitudinal edges, that is it tapers traversely outwardly. In FIG. 6 the workpiece 9 is rolled to a cross section with a relatively thin middle and relatively thick longitudinal edges. It is possible to achieve further cross-sectional variations by running the workpiece 9 through the stand 1 at axially offset locations.

Figure 2:
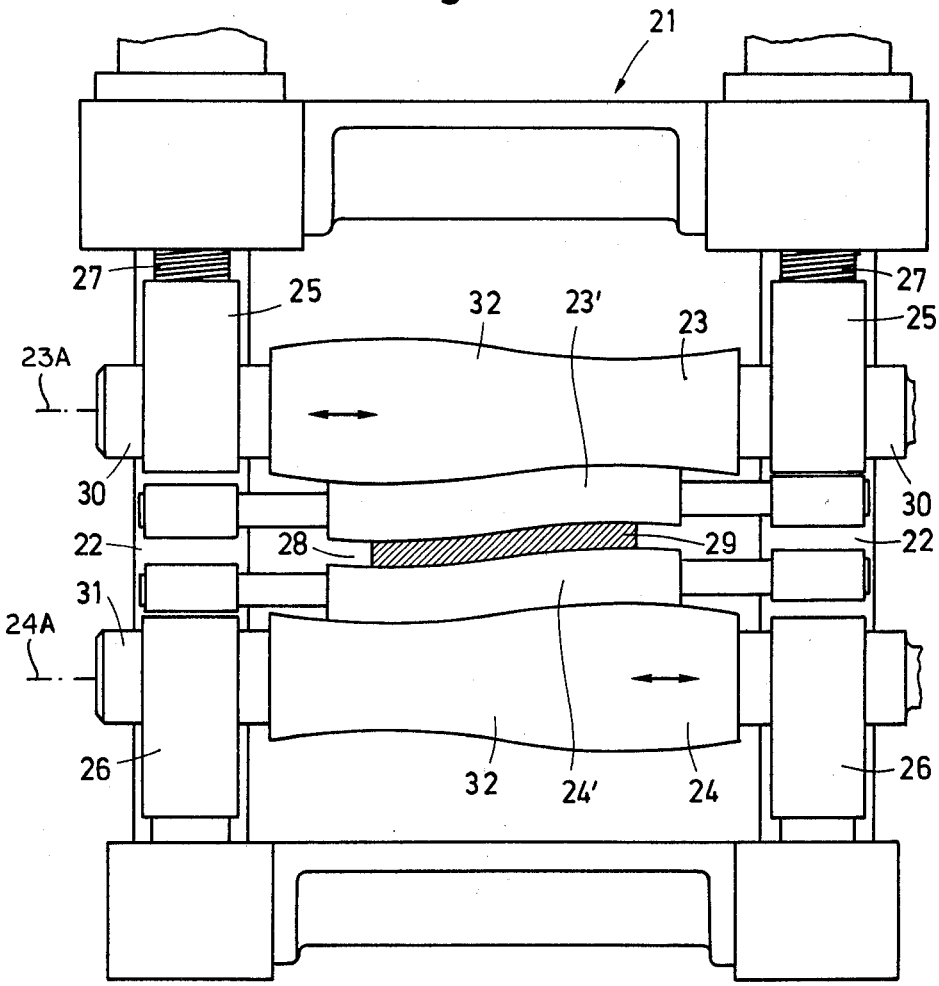
FIG. 2 is an end view of a four-high roll stand according to this invention.

FIG. 2 shows a four-high roll stand 21 having a housing 22 carrying two working rolls 23' and 24'. Backup rolls 23 and 24 bear in conventional fashion against the rolls 23' and 24' and respectively have ends 30 and 31 journaled in bearing blocks 25 and 26 of the housing 22. The rolls 23' and 24' are centered on respective parallel axes and define a nip 28 for a workpiece 29, here a steel strip. The blocks 25 can be moved vertically relative to the blocks 26 by standard adjustment screws 27 and axially by means more specifically described in the above-cited patent documents.

The rolls 23 and 24 have, like the rolls 3 and 4 of FIG. 1, identical but oppositely oriented bottle-shaped bodies 32, each formed by rotation of a wholly curved generatrix about the respective axis. The rolls 23' and 24', however, are when unstressed of cylindrical shape, but are deformed by the backup rolls 23 and 24 into the illustrated shapes.

Figure 3:
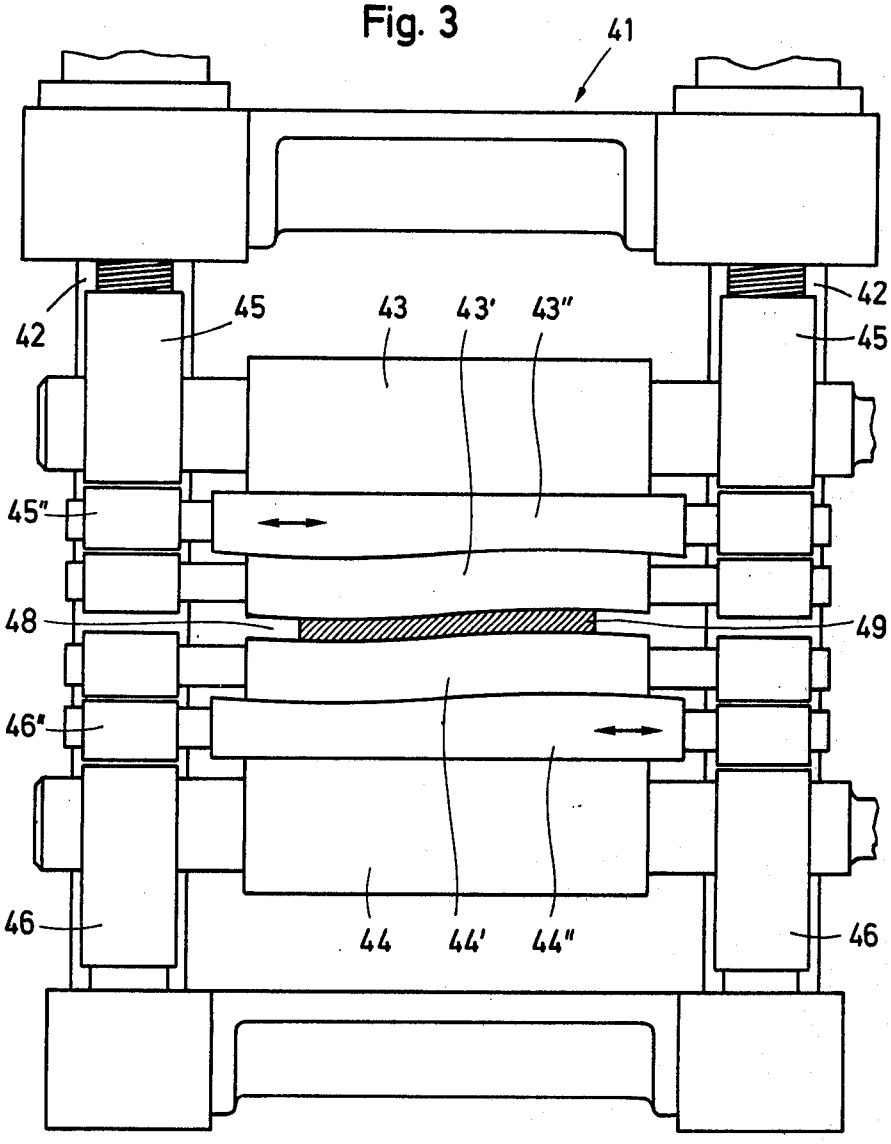
FIG. 3 is an end view of a six-high roll stand according to this invention.

FIG. 3 shows a six-high roll stand 41 having a housing 42 carrying two working rolls 43' and 44' having ends journaled in the housing 42. Primary backup rolls 43'' and 44'' bear in conventional fashion against the rolls 43' and 44' and larger-diameter secondary backup rolls 43 and 44 bear against the rolls 43'' and 44'', with these rolls 43 and 44 having ends carried in blocks 45 and 46 on the housing 42. The rolls 43' and 44' are centered on respective parallel axes and define a nip 48 for a workpiece 49, here a steel strip. Only the rolls 43'' and 44'' can be moved axially by means more specifically described in the above-cited patent documents.

The rolls 43'' and 44'' have identical but oppositely oriented bottle-shaped bodies, each formed by rotation of a wholly curved generatrix about the respective axis. The rolls 43' and 44', however, are when unstressed of cylindrical shape, but are deformed by the backup rolls 43'' and 44'' into the illustrated shapes. The rolls 43 and 44 are also cylindrical.

Figure 7:
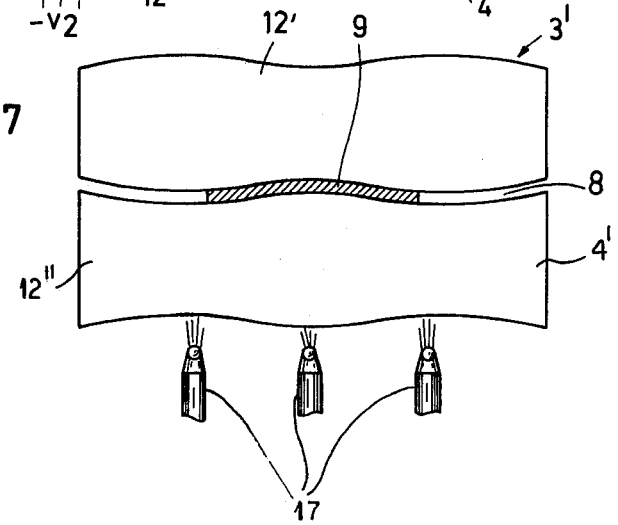
FIG. 7 is a view similar to FIG. 4 showing another roll stand according to this invention.

FIG. 7 shows rolls 3' and 4' whose bodies 12' and 12'' are complementary, but formed of undulatingly succeeding concave and convex shape. This may be achieved thermally by nozzles 17, with the sprays from these nozzles of a temperature to cause the regions that are supposed to be concave to shrink, by cooling them, and the regions that are supposed to be concave to swell, by heating them or allowing them to be hot.

It is possible with any of the systems according to the instant invention to steplessly vary the shape of the nip between the working rolls by displacing the contour rolls axially relative to each other. The invention can be employed in hot and cold rolling operations, as well in one-way and reversing stands.

We claim:

1. A rolling stand comprising:

a housing defining a pair of parallel and spaced axes defining a plane;

respective rolls having roll ends journaled in said housing at said axes and roll bodies axially symmetrical about the respective axes and having centered on the respective axes complementary roll-body surfaces of noncylindrical shape and each formed by rotation of a continuously curved generatrix about the respective axis, one of said rolls being displaceable axially relative to the other roll from an end position to another position, said surfaces forming at said plane only in said other position a uniform nip and at said plane in said end position a nonuniform nip; and means for displacing one of said rolls axially relative to the other of said rolls between said end position and said other position and for retaining said rolls in either of these positions.

2. The stand defined in claim 1 wherein said roll bodies are of identical shape but said one roll is reversed 180° relative to said other roll.

3. The stand defined in claim 2 wherein said surfaces each have one half of outwardly convex shape and another half of outwardly concave shape.

4. The stand defined in claim 1 wherein said roll surfaces are of different shape.

5. The stand defined in claim 4 wherein one of said roll surfaces is mostly outwardly convex and the other of said roll surfaces is mostly outwardly concave.

6. The stand defined in claim 1 wherein said roll surfaces each have a plurality of outwardly convex and a plurality of outwardly concave regions alternating axially therewith.

7. The stand defined in claim 1 wherein said roll surfaces are of said shapes at ambient temperature.

8. The roll stand defined in claim 1, further comprising means for differentially thermally influencing axially offset regions of said roll bodies for imparting the respective shapes thereto.

9. The roll stand defined in claim 1, further comprising means for swinging one of said roll bodies into a position with its axis nonparallel to the axis of the other of said roll bodies but still in said plane of said axes of said housing.

10. The roll stand defined in claim 1, further comprising means for displacing one of said roll bodies transverse to said plane of said of said axes of said housing into a position with its axis inclined to said plane of said axes of said housing.

* * * * *